United States Patent [19]

Belina

[11] 4,259,909

[45] Apr. 7, 1981

[54] VERTICALLY ADJUSTABLE TABLE

[76] Inventor: Casimiro Belina, 12306 Wilkens Ave., Rockville, Md. 20852

[21] Appl. No.: 36,288

[22] Filed: May 7, 1979

[51] Int. Cl.[3] ..... A47B 85/00

[52] U.S. Cl. ..... 108/12; 108/83; 108/161

[58] Field of Search ..... 108/12, 161, 115, 88, 108/83, 125, 126, 127; 403/403, 401; 248/188.6

[56] References Cited

U.S. PATENT DOCUMENTS

| | | | |
|---|---|---|---|
| 1,206,123 | 11/1916 | McKay | 108/83 |
| 2,872,711 | 2/1959 | Killebrew | 403/401 X |
| 3,074,771 | 1/1963 | Wilson | 108/12 |
| 3,212,952 | 10/1965 | Turner | 108/161 X |
| 3,213,570 | 10/1965 | Abramson, Jr. | 108/161 X |
| 3,688,707 | 9/1972 | White | 108/161 X |

FOREIGN PATENT DOCUMENTS

| | | | |
|---|---|---|---|
| 880030 | 12/1942 | France | 108/12 |
| 1129818 | 9/1956 | France | 108/12 |
| 1151928 | 8/1958 | France | 108/12 |
| 783308 | 9/1957 | United Kingdom | 108/12 |

*Primary Examiner*—James T. McCall

[57] ABSTRACT

This invention relates to a combination dining table and coffee table, adjustable to each of two levels which possesses perfect stability by the provision of rod supported pivotally actuating legs wherein each of said legs are composed of a short leg portion and a long leg portion integrally connected together at an obtuse angle and provided with a circular opening in the corner area of said angle area for insertion therethrough of said supporting rod and wherein each of said legs are individually and independently suspended on rods that are supported by means at each end.

13 Claims, 8 Drawing Figures

VERTICALLY ADJUSTABLE TABLE

This invention relates to a unique form of table for use in a small efficiency apartment in which under normal usage it is a coffee table. When needed, by simply pivoting the long leg portion into position, the table becomes suitable for use as a dining table.

It is an object of this invention to provide a table which is a finely designed piece of furniture that is capable of being strong and rigidly supported in use on each of the two usable levels.

It is a further object to obtain such two level support by employing a simple pivoting action.

It is a further object to connect the long and small portion of the leg so that maximum bonding strength is obtained.

Another object is to so shape the leg portions as to obtain maximum supportability.

It is a further object to employ a square, rectangular, circular or oval top and using either 4 or 6 supporting legs.

It is a further object to suitably space the leg supports to allow for extension of a centrally separated half-portions of a table top for insertion therebetween of additional slats.

In the prior art, such as Sternkopf U.S. Pat. No. 2,636,794, pivoting legs are used but they are connected to the table top by means of locking piano hinges making it difficult to unlock to use the alternate height. In Hodgman U.S. Pat. No. 2,688,524, the connecting means are both anchor means and hinges making the adjustment to a desired height very difficult.

In applicant's table the use of supporting rods, are not only not visible to the user but also requires simple hand manipulation of pivoting to obtain a desired height.

These and other features of the table structure of the instant invention are described in further detail below in connection with the accompanying drawings in which.

Figure 1:
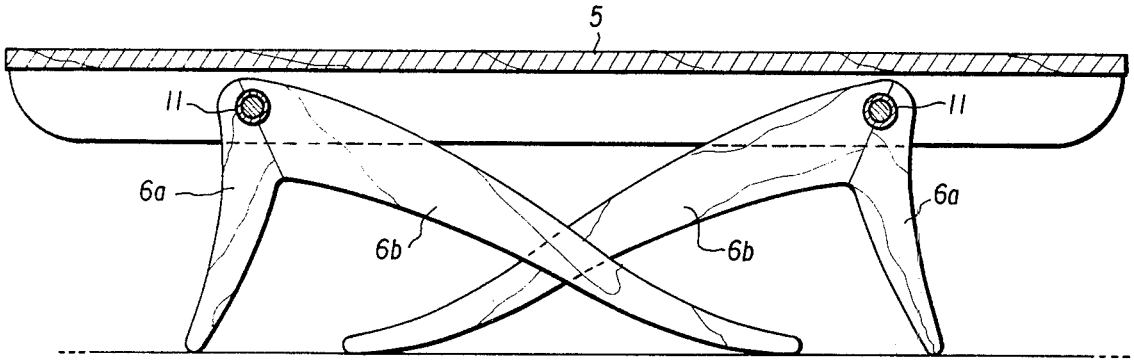
FIG. 1 is a side elevation partly in cross-section of the table shown at its lower height.
Figure 2:
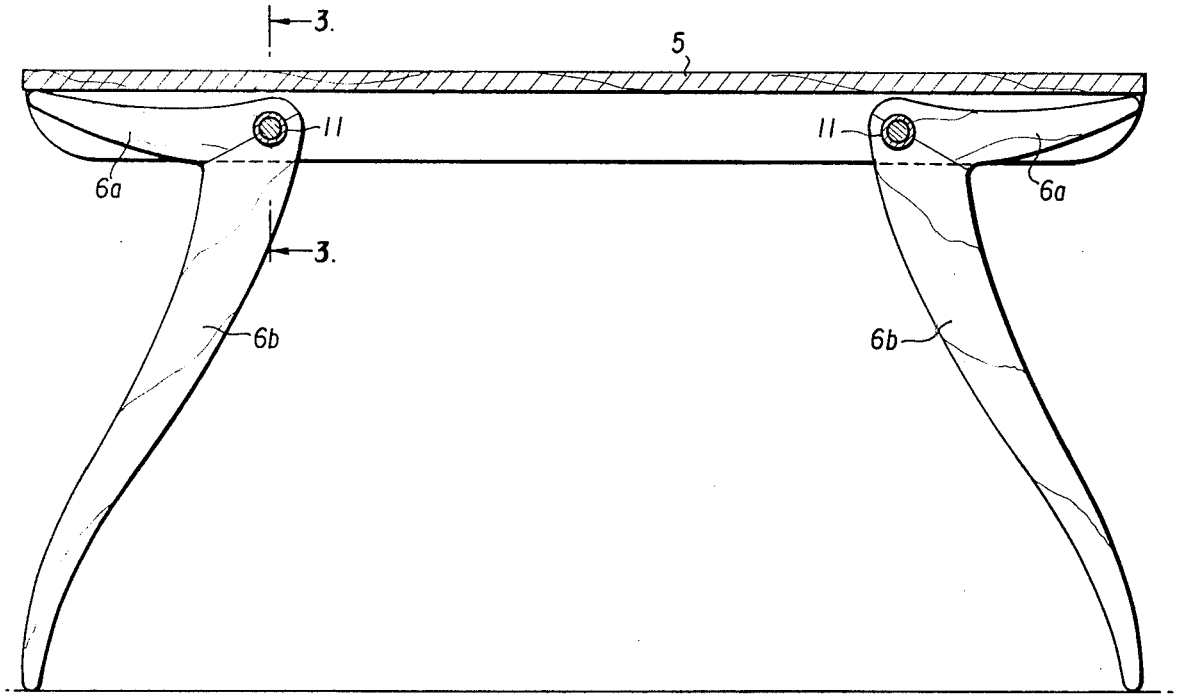
FIG. 2 is a side elevation partly in cross-section of the table shown at its higher height.
Figure 3:
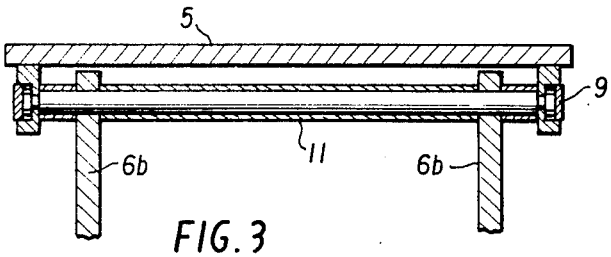
FIG. 3 is a cross-section taken on lines 3—3 of FIG. 2 showing the rod construction.
Figure 5:
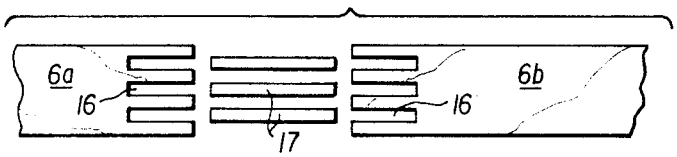
FIG. 5 shows an elevation (exploded) of the means used to integrally connect the short and long portions of the leg.

Referring now in detail to the drawings and more particularly, at first, to FIG. 1, showing a table structure embodying the present inventin comprising a main table top 5, which can be composed of two halves which can be extended along underlying tracks and being supported by 4 legs. Each of these legs are fashioned for strength and beauty. The long grain is utilized in each portion of leg. The manner of connecting the short portion of the leg 6*a* to the long portion of the leg 6*b* for maximum strength is best illustrated in FIG. 5 wherein there is shown three sets of opposing grooves 16 about 2 inches in depth. Three 4 inch inserts 17 of cross-grained wood are glued into each of these 3 sets of slots. Although this is the preferred manner of joining portions 6*a* and 6*b* together for maximum strength, it is possible to use any desired equivalent connecting means such as tongue and groove or special strength glue.

Figure 4:
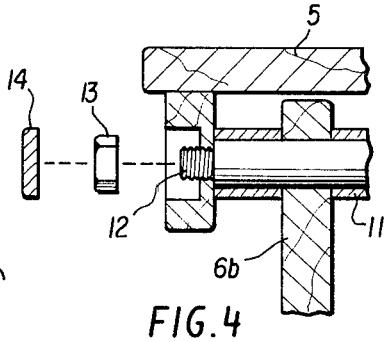
FIG. 4 shows an enlarged fragmentary view of the rod connection means.
Figure 6:
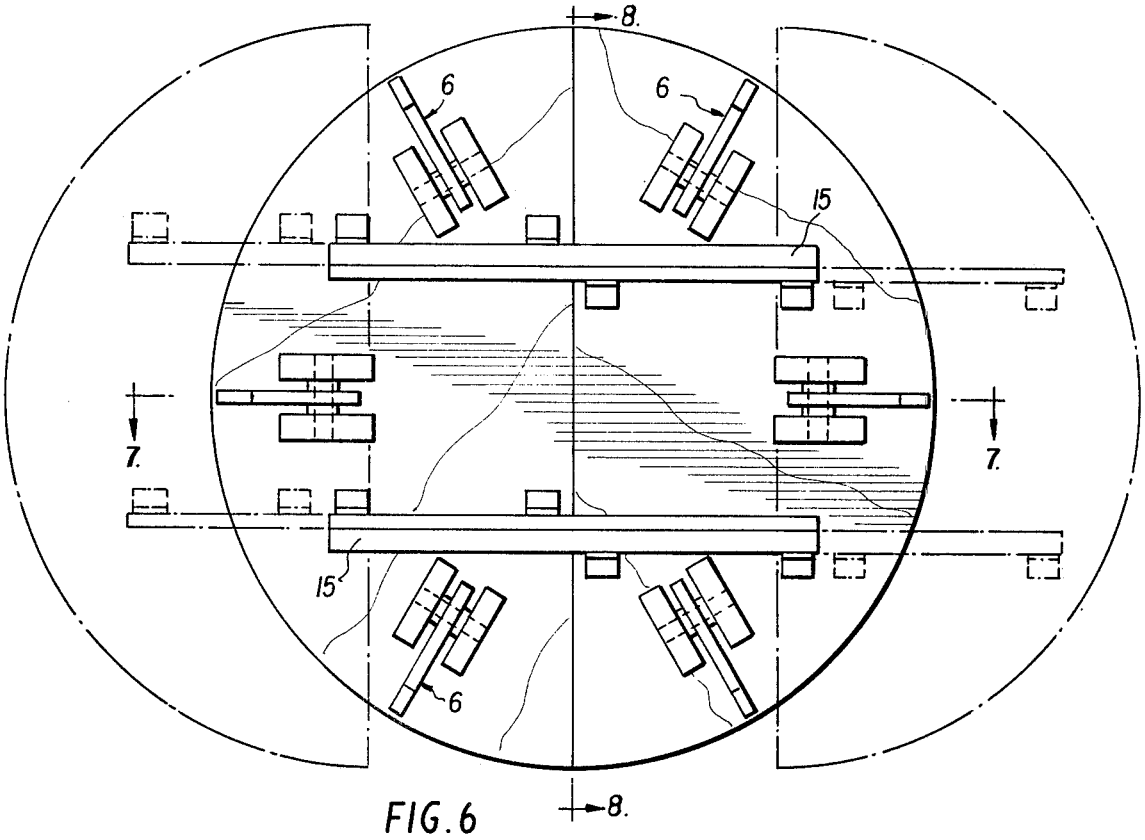
FIG. 6 is the underside view of a second embodiment of the invention using 6 legs.
Figure 7:
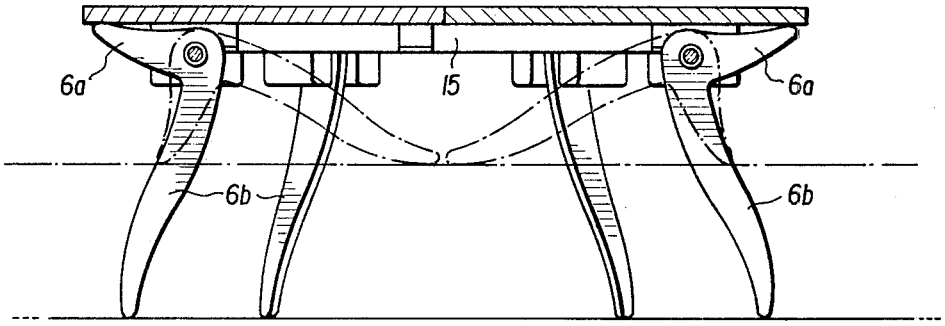
FIG. 7 is a cross-section on lines 7—7 of FIG. 6.
Figure 8:
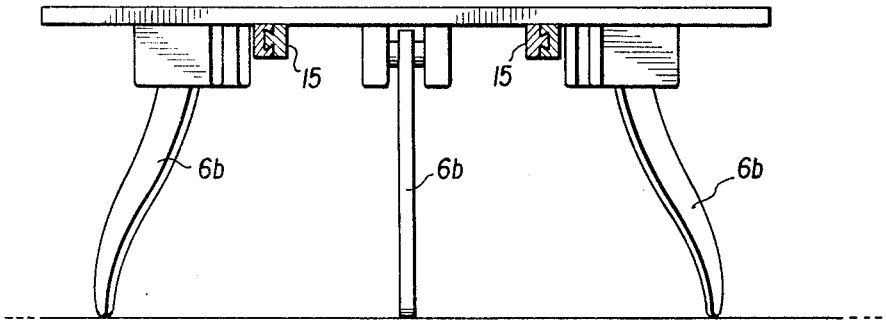
FIG. 8 is a cross-section on lines 8—8 of FIG. 6.

In order to show how rod 9 is connected to the table, refer to FIGS. 6, 7 and 8 wherein rod 9 sits in wood housing 11. Individual supports 10*a* and 10*b* are provided to support each individual rod on which the leg is mounted. The end connection is shown in FIG. 4 wherein said rod has a screw thread 12 to which is connected nut 13. Wood member 14 is applied to mask said nut. The leg sections 6*a* and 6*b* are gracefully bow shaped, not only to yield a pleasing appearance but also to provide stronger stability and support. Thus, each point of the legs yields maximum support for the table top.

FIG. 6 shows a 6 leg support for a round table top that consists of 2 halves so that by extension along tracks 15 an added board can be inserted. Each of the six legs are individually suspended on its own individual rod as shown in FIGS. 7 and 8 which in turn is attached to the table by two supports 10*a* and 10*b*, one at each end. When the short leg porton is to be used as for a coffee table as shown in FIG. 7, the leg is pivoted into such a position as to enable both the 6*a* portion and the 6*b* portion to rest securely on the floor. When used as a dining room table, the short portion 6*a* of the leg being bowed touches the underside of the table top while the long portion of the leg because of its outwardly bowed shape securely and strongly supports the table top. FIGS. 6 and 8 show how the track means is located so as to fit snugly with the pivoting legs.

Dependant upon the shape of the table top, 4 legs or more can be used. For a square or rectangular table, 4 legs are sufficient. For an oval or round table, 6 legs would be used. In all cases, the legs are pivotally supported by means of rods.

Although the illustration describes a table made of wood, it is obvious that the table can be made of plastic, glass, or metal, or metal coated plastic.

Because of the ease of pivoting the supporting legs, the change in height can be easily accomplished, by even a child. The advantage of strong support because of use of parallel graining and gently bowed shape adds to its ultimate utility in cramped dwellings. It is strongly supported in each of the 2 positions.

The present invention has been described in detail for purposes of illustration only and is not to be limited by that description or otherwise except as defined in the appended claims.

What is claimed is:

1. In a combination coffee and dining room table having a top, which is adjustable at each of two levels of height, and leg members, wherein each leg comprises a short leg and a long leg porion integrally connected together at an obtuse angle and having a pivotal connection in the juncture of said angle, the improvement comprising, the combination of independent legs and leg suspension means, said suspension means including two spaced support blocks being disposed in close proximity to each side of said juncture of said short and long leg portions, each of said independent legs being pivotally mounted on a rod, said rod being attached to and extending between said spaced support blocks, whereby said independant legs and suspension means may be selectively mounted on the underside of a table top having various configurations.

2. The table of claim 1 wherein 4 legs are used for a square or rectangular table top.

3. The table of claim 1 wherein 6 legs are used for a circular or oval table top.

4. The table of claim 1 wherein each portion of leg, both short and long, are so connected as to provide the grain of the wood along its longitudinal length for extra strength.

5. The table of claim 1 wherein each portion of each leg is bowed outwardly from its pivot point to provide for greater support.

6. The table of claim 1 wherein the connection of the short leg portion to the long leg portion is made by cross-grained shaped inserts in opposed grooves.

7. The table of claim 1 wherein the rod supporting the legs are covered in a housing and its screw tip is connected to a nut which is masked by a strip of wood.

8. The table of claim 1 wherein track-means for halves extension of the top is so located as not to interfere with the pivoting legs.

9. The table of claim 1 wherein when used as a coffee table both portions of the pivotal legs contact the floor.

10. The table of claim 1 wherein its composition is wood.

11. The table of claim 1 wherein its composition is plastic.

12. The table of claim 1 wherein its composition is metal.

13. The table of claim 1 wherein its composition is glass.

* * * * *